US010100586B2

(12) United States Patent
Tilley et al.

(10) Patent No.: US 10,100,586 B2
(45) **Date of Patent: *Oct. 16, 2018**

(54) DOWNHOLE ELECTRICAL CONNECTOR

(71) Applicant: Halliburton Energy Services, Inc., Houston, TX (US)

(72) Inventors: Jim Darin Tilley, Kingwood, TX (US); John Kenneth Snyder, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/427,304

(22) Filed: Feb. 8, 2017

(65) Prior Publication Data

US 2017/0145755 A1 May 25, 2017

Related U.S. Application Data

(62) Division of application No. 14/412,271, filed as application No. PCT/US2014/045724 on Jul. 8, 2014, now Pat. No. 9,695,645.

(60) Provisional application No. 61/844,058, filed on Jul. 9, 2013.

(51) Int. Cl.

| | |
|---|---|
| ***H01R 13/523*** | (2006.01) |
| ***E21B 17/02*** | (2006.01) |
| ***H01R 13/52*** | (2006.01) |
| ***E21B 17/07*** | (2006.01) |
| ***H01R 13/187*** | (2006.01) |
| ***H01R 13/533*** | (2006.01) |
| *E21B 47/00* | (2012.01) |

(52) U.S. Cl.

CPC ..... *E21B 17/028* (2013.01); *E21B 17/023* (2013.01); *E21B 17/07* (2013.01); *H01R 13/187* (2013.01); *H01R 13/523* (2013.01); *H01R 13/5219* (2013.01); *H01R 13/533* (2013.01); *E21B 47/00* (2013.01)

(58) Field of Classification Search

CPC ..... H01R 13/5219; H01R 13/533; H01R 13/187; E21B 17/003

USPC ..... 439/191, 194, 195, 501

See application file for complete search history.

(56) References Cited

U.S. PATENT DOCUMENTS

| | | | |
|---|---|---|---|
| 2,706,616 | A | 4/1955 | Osmun |
| 4,220,381 | A | 9/1980 | van der Graaf |
| 4,416,494 | A | 11/1983 | Watkins et al. |

(Continued)

FOREIGN PATENT DOCUMENTS

| | | | |
|---|---|---|---|
| CN | 1711663 | A | 12/2005 |
| CN | 201173113 | Y | 12/2008 |

(Continued)

OTHER PUBLICATIONS

Translation of Russian office action dated Aug. 8, 2016, 7 pages.

(Continued)

*Primary Examiner* — Harshad C Patel

(74) *Attorney, Agent, or Firm* — Alan Bryson; Parker Justiss, P.C.

(57) ABSTRACT

An electrical connector assembly positionable in a wellbore includes a flexible conductor, a first hanger ring connected to a first end of the flexible conductor, a first hanger ring landing shelf in an outer housing, a second hanger ring positioned on a second end of the flexible conductor, and a second hanger ring landing shelf in the housing.

16 Claims, 4 Drawing Sheets

(56) References Cited

U.S. PATENT DOCUMENTS

| | | | |
|---|---|---|---|
| 4,806,928 | A | 2/1989 | Veneruso |
| 5,323,853 | A | 6/1994 | Leismer et al. |
| 6,712,146 | B2 | 3/2004 | Estep et al. |
| 6,780,037 | B1 | 8/2004 | Parmeter et al. |
| 7,225,876 | B2 | 6/2007 | Laureano |
| 7,535,377 | B2 | 5/2009 | Hall et al. |
| 7,578,360 | B2 | 8/2009 | Haughom |
| 7,854,275 | B2 | 12/2010 | Mock et al. |
| 7,886,832 | B2 | 2/2011 | Partouche |
| 7,901,240 | B2 | 3/2011 | Jackson et al. |
| 2007/0181305 | A1 | 8/2007 | McGavern, III et al. |
| 2008/0308318 | A1 | 12/2008 | Moore |
| 2009/0101328 | A1 | 4/2009 | Leslie et al. |
| 2011/0272148 | A1 | 11/2011 | Lovell et al. |
| 2016/0230477 | A1 | 8/2016 | Tilley et al. |

FOREIGN PATENT DOCUMENTS

| | | | |
|---|---|---|---|
| CN | 201221352 | Y | 4/2009 |
| CN | 202578665 | U | 12/2012 |
| JP | 2005511929 | | 4/2005 |
| RU | 2111352 | C1 | 5/1998 |
| RU | 17197 | U1 | 3/2001 |
| RU | 2190272 | C2 | 9/2002 |
| RU | 2401932 | C2 | 10/2010 |
| RU | 2423609 | C1 | 7/2011 |
| SU | 221606 | A1 | 7/1968 |
| WO | 2014182293 | A1 | 11/2014 |
| WO | 2015006310 | A1 | 1/2015 |

OTHER PUBLICATIONS

Lawrence, L., et al., "Intelligent Wired Drill Pipe System Provides Significant Improvements in Drilling Performance on Offshore Australia Development," OTC 20067, Offshore Technology Conference, May 2009, 8 pages.

Tomax as, Datasheet 051010, document retrieved on Jul. 23, 2014, 4 pages.

10
14
12
60
25
20
66
32
34
21
24
22
26
70
102
40
45
64
100
61
62
50

DOWNHOLE ELECTRICAL CONNECTOR

PRIORITY CLAIM

This application is a divisional of U.S. application Ser. No. 14/412,271, filed on Dec. 31, 2014, which application is a U.S. National Stage of International Application No. PCT/US2014/045724, filed Jul. 8, 2014, which claims priority to U.S. Provisional Application No. 61/844,058, filed Jul. 9, 2013.

TECHNICAL FIELD

This instant specification relates to a downhole tool and method for conducting electrical power and signals along a bottom hole assembly that expands and contracts in longitudinal length.

BACKGROUND

During well drilling operations, a drill string is progressively assembled at the surface from individual joints of drill pipe (or groups of joints called "stands) and lowered into a wellbore. The drill string may comprise these joints of drill pipe coupled together at the surface, along with other equipment useful during drilling such as a bottom hole assembly positioned at the distal end of the jointed drill pipe. The bottom hole assembly (BHA) may include tools such as well logging while drilling (LWD) and measurement while drilling (MWD) telemetry tools, with a drill bit coupled to the lower end. Also included in the bottom hole assembly above the drill bit may be a dynamic damper tool used to dampen oscillations in the drill string and bottom hole assembly. One commercial embodiment of such a dampener is an anti-stall tool available from the Tomax company ("Tomax AST tool") having concentric outer and inner housings, wherein the inner housing telescopes in and out of the outer housing to allow expansion and contraction of the of the bottom hole assembly in a longitudinal direction.

DETAILED DESCRIPTION

This document describes a downhole tool and method for conducting electrical signals along a bottom hole assembly ("BHA") 70 that expands and contracts in length.

Figure 1:
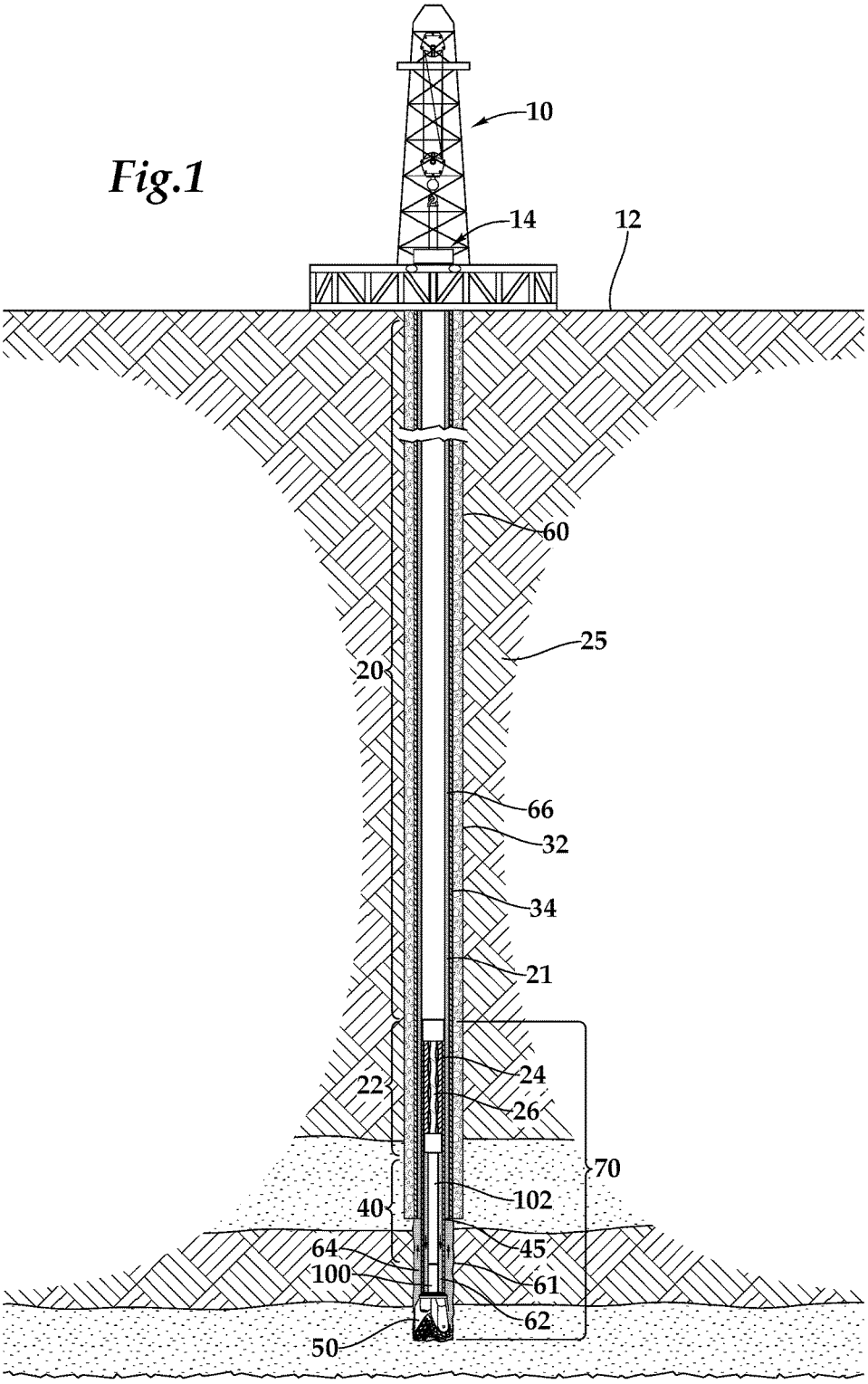
FIGS. 1 and 1A are elevation views of an example drilling rig and an example bottom hole assembly that allows for expansion and contraction of the bottom hole assembly longitudinally while drilling a wellbore.

FIG. 1 is an elevation view of an example drilling rig 10 located at or above the surface 12. Surface equipment 14 of the drilling rig 10 may rotate a drill string 20 disposed in a wellbore 60 to drill through one or more geologic formations 25 below the surface 12. The drill string 20 includes joints of drill pipe 21, and in the implementation illustrated a downhole power section 22 (e.g., a downhole positive displacement motor such as a Moineau type motor). In the implementation illustrated, the downhole power section 22 includes a stator 24 and a rotor 26 that may be rotated to transfer torque down the borehole to a drill bit 50 or other downhole equipment. A tool string 40 is attached to a longitudinal output shaft 45 of the downhole positive displacement motor. The wellbore 60 is reinforced by a casing 34 and a cement sheath 32 in the annulus between the casing 34 and the borehole. During normal drilling operations, the surface equipment 14 pumps drilling fluid 62 (aka drilling mud) down the drill string 20 and out ports in the bit 50 and then up the annulus 64 between the drill string and borehole wall and the annulus 66 between the inside wall of the casing 34. The rotor 26 of the downhole motor in the power section is rotated due to a pumped drilling fluid 62 pressure differences across the rotor 26 of the power section 22 relative to the stator. It will be understood that in other implementations, surface equipment 14 on the drilling rig 10 rotates the drill string 20 and the downhole power sections 22 may or may not be present in the wellbore. In such implementation, rotation of the drill string by the surface equipment supplies rotational torque to rotate the drill bit 50.

Functional capabilities of downhole electronic sensors/transducers continue to develop, and the surface monitoring and assessment of actual downhole conditions and operating parameters of drilling, completion and workover equipment continues to advance (e.g., via the assessment of either real-time and/or recorded data from downhole). Sensors that measure parameters such as dynamic mechanical loadings, pressure differentials and temperature differentials are now capable of operating in harsh conditions in boreholes, either during drilling, completions or workover operations. It is desirable to position such sensors below and within downhole drilling and/or drilling and completion and workover equipment. However, the standard physical forms of such downhole equipment, in terms of geometry and/or materials, generally do not readily permit the passage of electronic signals. The provision and assessment of such data allows for optimization and provides benefits in equipment performance, reliability and longevity.

Since BHA drilling equipment generally is subjected to high level vibration and shock loading, solid state conductors and couplings are generally used. However, a circulation of fluid, impinging directly upon conductors and/or conductor components may negatively impact the flow area within drilling tubular or affect the physical integrity of the drilling tool internal or external components.

Additionally, new equipment is being developed for automated surface and downhole drilling systems, such as enclosed circulation drilling systems and electric drill bits (e.g., power pulse). A supply of electrical power, provided downhole to the drill bit or BHA equipment is needed for these systems and equipment.

In some examples, operation of the tool string 40 may transmit vibrations that can travel along the drill string 20. For example, the drill pipe 21 may flex and contact the wellbore 60 or a wellbore wall 61, sending vibrations along drill string 20. In another example, interaction of the drill bit 50 with the formation being drilled may cause vibrations that can travel along the drill string 20. In the implementation illustrated in FIGS. 1 and 1A, a vibration damper assembly 80 is included in the bottom hole assembly ("BHA") 70 to reduce the amount of vibration that is propagated along the tool string 40.

Figure 1A:
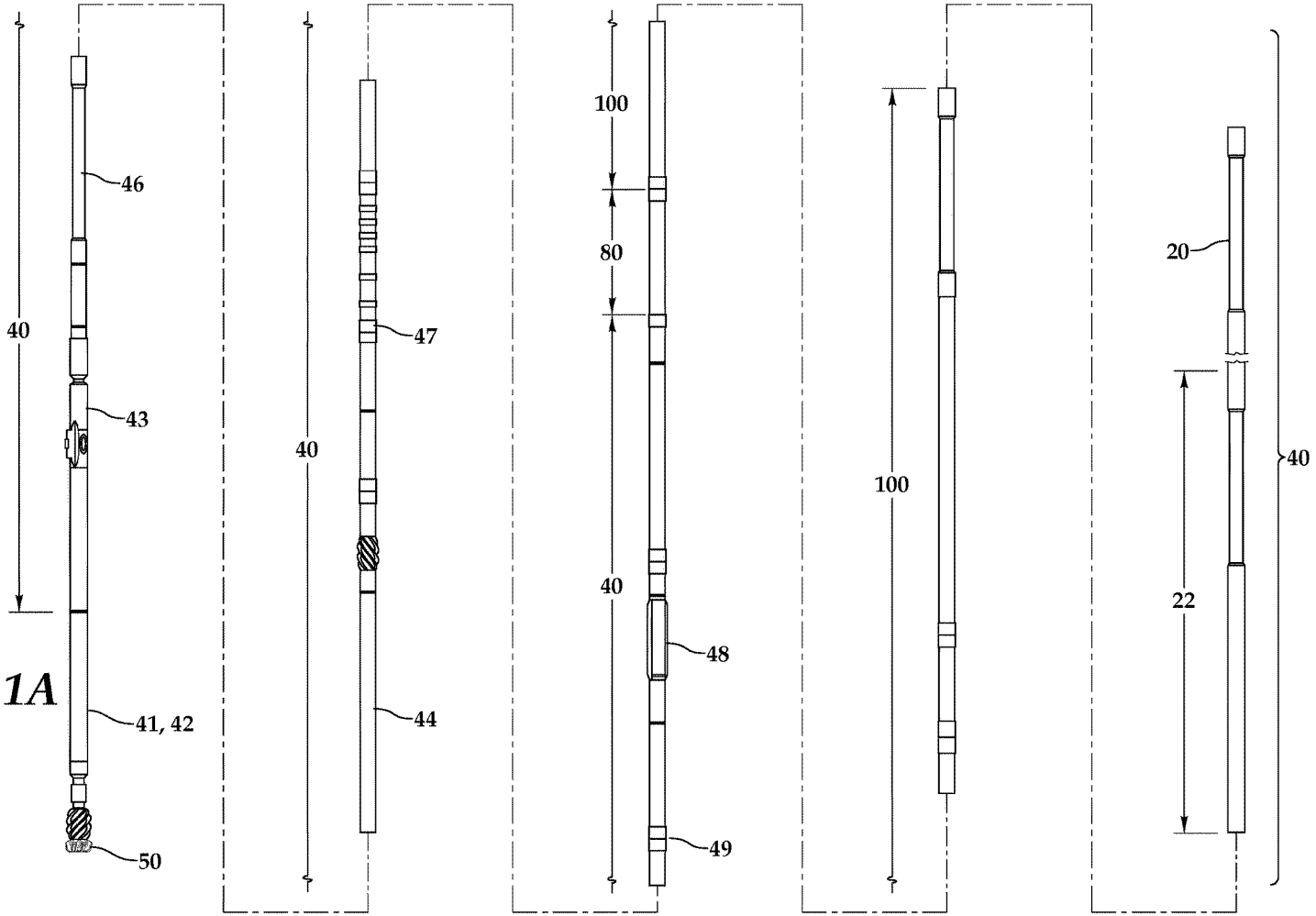

FIG. 1A is an enlarged elevation view of the example tool string 40 of FIG. 1. The tool string 40 may include one or more of the following sensors/tools: at-bit inclination sensor (ABI) 41; an azimuthal at-bit gamma sensor (ABG) 42, a remote steering tool (Geopilot RSS) 43; a dual gamma ray sensor (DGR) 44; a directional sensor 46, a resistivity sensor (EWR) 47; an azimuthal litho-density sensor (ALD) 48; and a compensated thermal neutron sensor (CTN) 49. The illustrated tool string 40 is illustrative of an implementation of an intelligent wired drill pipe system (e.g., a Halliburton Intellipipe tool system). However, the tool string 40 may include a variety of tools and sensors typical to the industry. In the illustrated implementation, the BHA 70 assembly includes the drill bit 50, tool string 40, power section 200 and an electrical connector assembly 100. The electrical conductor assembly 100 will be discussed further in the descriptions of FIGS. 2, 2A, 3 and 5. It will be understood that the BHA 70 may include some, all, or none of the components shown.

In the implementation illustrated, a power and/or signal (e.g. communications pathway) is provided through the bottom hole assembly 70 including the tool string 40. The tool string rotates and/or may have variable length in response to changes in weight on bit (WOB) and/or pressure on the dynamic damper tool 80 (e.g., the Tomax AST tool). In various implementations, the downhole electrical connector assembly 100 may be used as a communications pathway and/or a power pathway through various configurations of downhole tools, drill pipes, and/or drill collars, and is not limited to use only with the Tomax tool. For example, the downhole electrical connector assembly 100 may be used for communicating bottom hole assembly sub bus data and/or power. In another example, the downhole electrical connector assembly 100 of this disclosure can also be used for wired pipe systems such as a Halliburton IntelliPipe system and/or including RSS, MWD and LWD tools as illustrated and discussed in connection with FIG. 1A.

Referring now to FIGS. 2, 2A, 2B, 2C and 3, wherein side and cross sectional views illustrate of an embodiment of the downhole electrical connector assembly. The connector assembly 100 includes an upper longitudinal member 102. The upper longitudinal member 102 is a tubular member (e.g. a conduit) with an electrical conductor 103 (e.g. conductive metallic rod, metallic wire, fiber optic or composite material) positioned inside the conduit. Positioned on an uphole portion of the upper longitudinal member 102 is a hanger ring 110 that is sized and configured to be received in a landing shelf 522 of an upper outer female housing member 520. A downhole portion of the connector assembly 100 includes a lower longitudinal member 210. A similar hanger ring 112 is configured to be received in a landing shelf 512 of a lower outer male housing member 510. The lower longitudinal member 210 is a conduit with an electrical conductor 203 positioned within the conduit. The hanger rings 110 and 112 each include a plurality of mounting apertures 540. Mounting bolts 542 may be passed and received into threaded apertures (e.g., female threaded bolt holes) in the shelves 512 and 522. Other types of mechanical connectors known in the art may be used to secure the hanger rings to the landing shelves. The hanger ring 110 and conduit of the longitudinal member 102 are insulated externally from the electrical conductor 103 running through the conduit. Likewise, the hanger ring 112 and conduit of the longitudinal member 210 are insulated externally from the electrical conductor 203 running through the conduit. The outer telescoping housing 500 includes the upper outer female housing member 520 that receives the lower outer male housing member 510. A seal assembly 530 seals the male housing member 510 to the female housing member 520. The lower male housing member 510 is movable longitudinally and rotatably in the outer female housing member 520 allowing for telescoping reduction and increase in the length of the housing 500.

The electrical connector assembly 100 includes at least one telescoping electrically conductive assembly 200 that includes a longitudinal receptacle 104 positioned in an end portion of the electrical conductor 103. The longitudinal receptacle 104 may be integral with longitudinal conductor 103 or be a separate tubular member positioned on and connected to the electrical conductor 103. The longitudinal receptacle 104 is configured to receive a proximal end portion of the electrical conductor 203. The end portion of conductor 203 is movable longitudinally and rotatably in the longitudinal receptacle 104 allowing for a telescopic reduction or increase in the length of the telescoping electrically conductive assembly 200.

The telescoping assembly 200 further includes a female longitudinal extension 120 and transition section 122 of the upper longitudinal member 102. The lower longitudinal member 210 is movable longitudinally and rotatably in the female longitudinal extension 120 allowing for a telescopic reduction or increase in the length of the telescoping electrically conductive assembly 200. An insulator 226 is disposed between the female portion 104 of the electrical conductor 103 and the longitudinal member 210.

Figure 4:
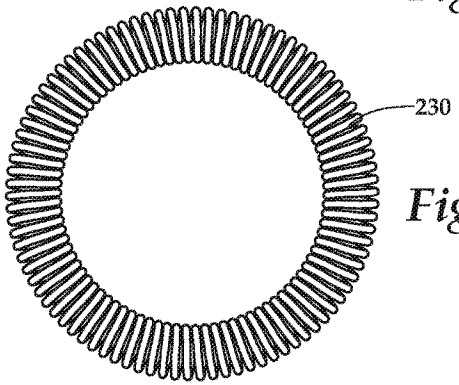
FIG. 4 is a top view of an example electrical contact spring.

A seal assembly 224 prevents drilling fluid 62 flowing inside of the housing 500 of the electrical connector assembly 100 and around the electrical conductor 203 from entering the telescoping assembly 200 and shorting out the electrical connection therein. In some implementations the telescoping electrically conductive assembly 200 may be pressure balanced with grease and pressure ports as is known in the art. On an exterior surface of the telescoping assembly 200 may be a ribbed (or otherwise configured) centralizer formed from a polymeric material. Disposed inside the telescoping assembly is a plurality of contact springs 230. FIG. 4 illustrates top view of an exemplary contact spring 230. The contact spring 230 allows for longitudinal and rotational movement of the electrical conductor 203 inside the longitudinal receptacle 104 of conductor 103 while making electrical contact and providing for transmission of electrical power and/or signals between the members during such movement. The springs 230 also facilitate electrical conductivity and or signal transmission in the absence of movement of the electrical conductors 203 and 103 relative to each other.

Positioned on the uphole portion of the connector 100 is a socket and pin type electrical connector 320. The pin type electrical connector 320 is affixed to the hanger ring 110 and connected electrically to the electrical conductor 103 positioned inside the longitudinal member 102. The pin connector 320 includes an input/output conductor 104 for carrying power or a signal up or down the bottom hole assembly 70. In a like manner, positioned on the downhole portion of the connector 100 is a socket and pin type connector 322. The pin type electrical connector 322 is affixed to the hanger ring 112 and connected electrically to the electrical conductor 203 positioned inside the longitudinal member 210. The pin connector 322 includes and input output conductor 214 for carrying power or a signal up or down the bottom whole assembly 70. It will be understood other types of electrical connectors as known in the art may be used to affect the electrical coupling of the assembly 100 with uphole and downhole equipment.

The electrical conductors 103 and 203 may transmit one or both power and signal to or from a component of the tool strings 40 or bottom hole assembly 70. A signal may include an instruction or data transmitted to or from a component of the tool string 40 and bottom hole assembly 70. Power and/or signal from downhole may pass into the electrical connector assembly 100 from an electrical conductor 214 in the pin connector 322 which is connected electrically to conductor 203 located inside longitudinal member 210. Signal and/or power then flows via contact spring 230 to an inner surface of longitudinal receptacle 104 of conductor 103 which insulated from longitudinal member 102. The power or signal flows along conductor 103 to an electrical conductor 104 located in pin connector 320 and then out of the electrical connector assembly 100 and uphole.

Figure 3:
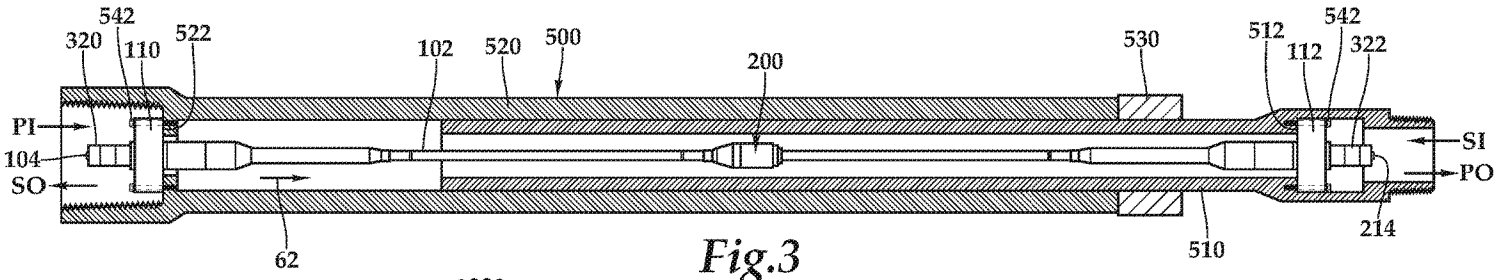
FIG. 3 is a cross sectional side view of the downhole electrical connector assembly of FIG. 2 including a telescoping housing.

As indicated in FIG. 3, power in (PI) may be received at connector 320 and pass through electrical connector assembly 100 and power out (PO) at the downhole end connector 322. Likewise, signal in (SI) may flow in via connector 112 and may flow through electrical connector assembly 100 and signal out (SO) connector 320. It will be understood that the electrical power and signals may flow in opposite directions from that as previously described depending on the needs of the tools and sensors disposed in the bottom hole assembly above and below the electrical connector assembly 100.

The electrical connector assembly 100 and the housing 500 may be positioned in the bottom hole assembly either above or below the MWD and/or LWD tools and/or a remote steerable system (RSS), but above the bit. The housing 500 generally has threaded connections that allow coupling of the housing 500 with the aforementioned tools. The ability of the electrical connector assembly 100 to transfer electrical power and transmit data through the central bore of the housing of the electrical connector assembly 100 permits the reliable transmission of a relatively large amount of data which is captured by downhole tool sensors, through various downhole drilling tool tubular based tools. The receipt, analysis and application of this data contribute directly to the real-time or post-job assessment process, increasing effectiveness of drilling operations and downhole drilling tool performance and reliability. The electrical connector assembly 100 is able to transmit electrical power from surface or from a point higher up in the drill string to electric drill bits (e.g., power pulse). The electrical connector assembly 100 is applicable to any downhole electrical or electro-mechanically activated BHA tool used during the drilling or workover process where relative rotation and/or length changes are anticipated.

Figure 2:
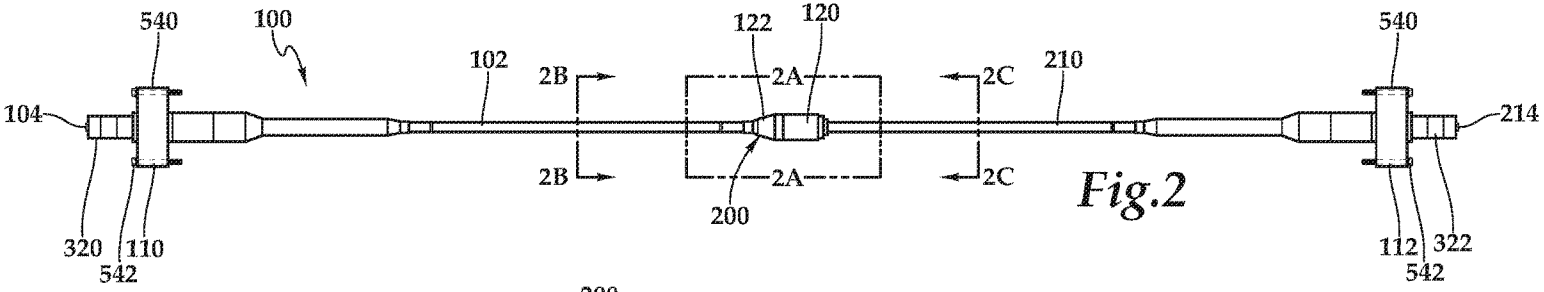
FIG. 2 is a side view of components of an example downhole electrical connector assembly providing for expansion and contraction longitudinally.
Figure 2A:
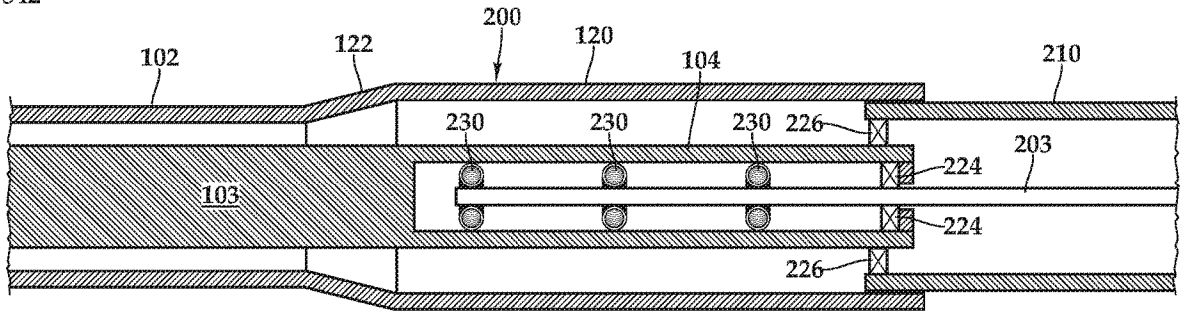
FIG. 2A is an enlarged partial cross-sectional side view illustrating components of the example downhole electrical connector assembly of FIG. 2.
Figure 2C:
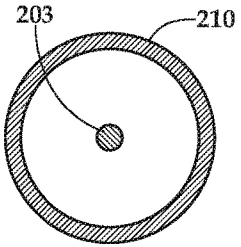
FIGS. 2B and C are enlarged transverse cross-sectional views of the downhole electrical connector assembly of FIG. 2.
Figure 2B:
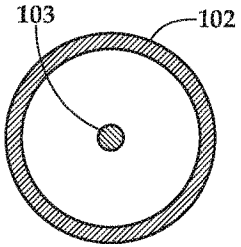
Figure 5:
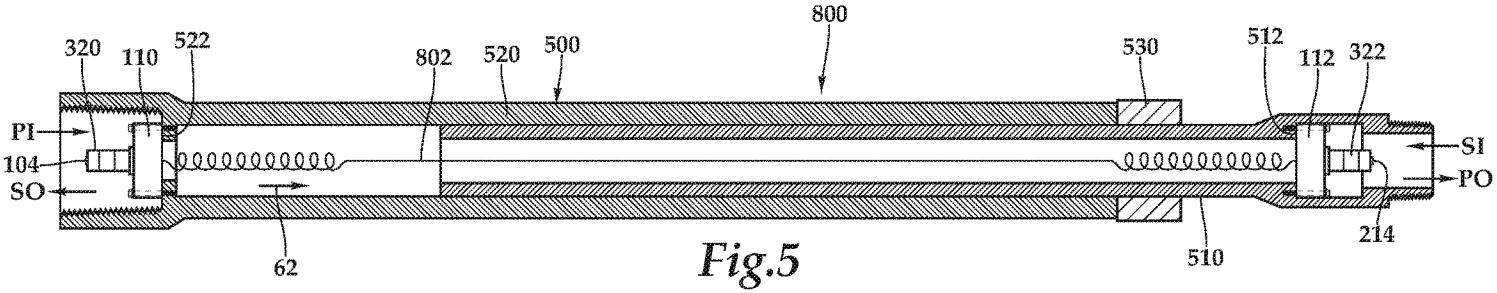
FIG. 5 is a cross sectional side view of an alternate electrical connector assembly having a flexible conductor disposed in a telescoping housing.

FIG. 5 is a side cross sectional view illustrating an alternative electrical connector assembly 800, wherein a flexible conductor 802 is substituted for the longitudinal members 102 and 210 of the telescoping assembly 200 and the electrical connector assembly 100 illustrated in FIGS. 2 to 3. The electrical conductor 802 is solid with a non-conductive outer coating as distinguished from the members 102 and 210 which are configured as a conduit with an electrical conductor inside. Electrical power and/or signals may be transmitted uphole or downhole through the flexible conductor 802 to and from conductors 104 and 214 of pin and socket connector 320 and 322. The flexible conductor 802 allows for longitudinal and twisting movement of the housing 500 in which the flexible conductor 802 is positioned. The electrical conductor 802 may be configured as a single conductor that transmits both power and signal. It is understood that the implementation of the electrical connector assembly 800 may be used inside of downhole jars, reamers, dynamic dampener tool 80 and drill pipe 21, instead of and/or in addition to, use in the electrical connector housing 500.

The use of terminology such as "upper," "lower," "above," and "below" throughout the specification and claims is for describing the relative positions of various components of the system and other elements described herein. Unless otherwise stated explicitly, the use of such terminology does not imply a particular position or orientation of the system or any other components relative to the direction of the Earth gravitational force, or the Earth ground surface, or other particular position or orientation that the system other elements may be placed in during operation, manufacturing, and transportation.

The details of one or more embodiments of the invention are set forth in the accompanying drawings and the description below. Other features, objects, and advantages of the invention will be apparent from the description and drawings, and from the claims.

What is claimed is:

1. An electrical connector assembly positionable in a wellbore, said electrical connector assembly comprising:

a flexible conductor;

a first hanger ring connected to a first uphole end of the flexible conductor;

a first hanger ring landing shelf in an outer housing;

a second hanger ring positioned on a second downhole end of the flexible conductor; and a second hanger ring landing shelf in the housing, wherein the first and second hanger ring landing shelfs are rigidly coupled to the housing and located between the first and second hanger rings, and further wherein the housing, and not the flexible conductor, is configured to support a weight of a tool connected thereto.

2. The assembly of claim 1, wherein the outer housing includes a telescoping portion disposed intermediate of a first end and second end of the outer housing, said telescoping portion including an outer male housing member slidably and rotatably received in a portion of an outer female housing member.

3. The assembly of claim 2, wherein the female outer housing member includes the first hanger ring landing shelf configured to receive the first hanger ring and the outer male housing member includes the second hanger ring landing shelf configured to receive the second hanger ring.

4. The assembly of claim 2 further comprising:

a first pin and socket type connector disposed on the first hanger ring and electrically coupled to the flexible conductor; and a second pin and socket type connector disposed on the second hanger ring and electrically coupled to the flexible conductor.

5. The assembly of claim 1 further comprising:

a first pin and socket type connector disposed on the first hanger ring and electrically coupled to the flexible conductor; and a second pin and socket type connector disposed on the second hanger ring and electrically coupled to the flexible conductor.

6. The assembly of claim 1, wherein the first and second hanger rings each contain one or more mounting apertures.

7. The assembly of claim 6, further including one or more mounting bolts engaging the one or more mounting apertures to secure the first and second hanger rings to the first and second hanger ring landing shelfs, respectively.

8. The assembly of claim 1, wherein the first and second hanger rings are secured to the first and second hanger ring landing shelfs, respectively.

9. The assembly of claim 1, wherein the housing has one or more connections for coupling to the tool.

10. The assembly of claim 9, wherein the one or more connections are one or more threaded connections.

11. A method of transmitting power or a signal in a wellbore comprising:

providing an electrical connector assembly including:

a flexible conductor;

a first hanger ring connected to an end of the flexible conductor;

a second hanger ring connected to an end of the flexible conductor; and slidably and rotatably receiving an outer male housing member in a portion of an outer female housing member;

positioning the first hanger ring in a first hanger ring landing shelf disposed inside the outer female housing member;

positioning a second hanger ring in a second hanger ring landing shelf disposed inside the outer male housing member, wherein the first and second hanger ring landing shelfs are rigidly coupled to the female housing member and male housing member, respectively, and located between the first and second hanger rings, and further wherein the female and male housing members, and not the flexible conductor, are configured to support a weight of a tool connected thereto;

positioning the electrical connector assembly in a bottom hole assembly;

positioning the electrical connector and bottom hole assembly in a wellbore;

conducting drilling operations in the wellbore comprising telescopically reducing and increasing a longitudinal length of the electrical connector assembly;

supplying a power or a signal to an input of the electrical connector assembly; and transmitting the power or signal through the flexible conductor disposed in the housing, and out the electrical connector assembly.

12. The method of claim 11, wherein the first and second hanger rings contain one or more mounting apertures.

13. The method of claim 12, further including one or more mounting bolts engaging the one or more mounting apertures to secure the first and second hanger rings to the first and second hanger ring landing shelfs, respectively.

14. The method of claim 11, wherein the first and second hanger rings are secured to the first and second hanger ring landing shelfs, respectively.

15. The method of claim 11, wherein the female and male housing members have one or more connections for coupling to the tool.

16. The method of claim 15, wherein the one or more connections are one or more threaded connections.

* * * * *